United States Patent [19]

McLaren

[11] 4,133,195

[45] Jan. 9, 1979

[54] DEVICE FOR MANAGING KEYS AND LOCKS

[76] Inventor: Michael J. McLaren, 2844 NW. 59th St., Seattle, Wash. 98107

[21] Appl. No.: 870,631

[22] Filed: Jan. 19, 1978

[51] Int. Cl.[2] ..... A47G 29/10

[52] U.S. Cl. ..... 70/456 R

[58] Field of Search ..... 70/456 R, 456 B, 457, 70/458, 459; 150/40; 24/3 K

[56] References Cited

FOREIGN PATENT DOCUMENTS

| | | | |
|---|---|---|---|
| 451402 | 10/1927 | Fed. Rep. of Germany | 70/456 R |
| 1200546 | 6/1959 | France | 70/456 R |
| 1252828 | 12/1960 | France | 70/456 R |
| 147609 | 1/1921 | United Kingdom | 70/456 R |

*Primary Examiner*—Robert L. Wolfe

*Attorney, Agent, or Firm*—Shlesinger, Fitzsimmons & Shlesinger

[57] ABSTRACT

A large loop or ring of spring steel, which is rectangular in cross section, has two separable ends, one of which is releasably securable in a recess in the other by means of a removable shackle or wire snap. A plurality of key blocks are removably mounted on the ring for sliding movement thereabout coaxially of the ring. In one embodiment the ring is solid and projects slidably through a corresponding rectangular recess which extends centrally through each key block; and in a second embodiment the ring is hollow and the blocks are slidably mounted in the rectangular bore of the block. Numeral-bearing tags are secured to the faces of the blocks in each embodiment; and in the second embodiment an arcuate opening is formed in the front wall of the ring so that the tags on the blocks will be viewable through the opening. A small swivel ring projects from the underside of each key block to have a key secured thereto by a wire snap. The blocks come in various colors so that their identification may be listed in a master log book containing colored sections with numbered lines for recording key vs. lock information, such as: number, location, name or names of persons with keys, location and number of duplicates, etc.

9 Claims, 9 Drawing Figures

DEVICE FOR MANAGING KEYS AND LOCKS

This invention relates to security, and more particularly to a novel method and device for use by those responsible for key-keeping. Even more particularly this invention relates to a unique device to be used in conjunction with a programmed log book, which displays by color, number and description, specific key-lock identification information, thereby affording the user a quick reference in the selection of the appropriate key for the particular lock.

It is conventional to attach numerous unidentified keys in random fashion to a simple ring. Methods occasionally used for identifying keys have been suboptimal by reason of poorly visible marks, lack of sticker adhesion, tag loss and cumbersomeness. Also, methods of cataloguing key-lock systems have not been perfected to the point where they can be of practical application. Thus countless keys of unknown application fill drawers or boxes, and needless expense in time and money occurs when duplicating and replacement is resorted to as the solution. Likewise, it is a formidable challenge for one not familiar with a set of keys to determine key-lock compatibility.

Because of these and other obvious shortcomings presently practiced, this invention is conceived as a simple, efficient, and unique solution.

It is an object of this invention to provide an improved, simple method for accurate key identification which can be used in the home, factory, or any other facility using keys and locks.

Another object of this invention is to provide a novel device which indexes and aligns keys on a swivel action retainer.

Still another object of this invention is to provide a novel key-keeper which facilitates the placement of keys thereon in a sequence corresponding to region, area, and function of the associated locks.

A further object of this invention is to provide a novel device of the type described which affords easy reorganization of keys thereon, and the addition and/or removal thereof.

Another object of this invention is to incorporate durable, legible and uniform color-number identification coding upon a device of the type described.

Still another object of this invention is to identify locks, duplicate keys and master keys with coding in concert with that displayed on a novel key-keeping device of the type described.

Another object of this invention is to provide handy compact retainers, as described, which are suitable for application to either small or large security systems.

A further object of this invention is to provide a functional identification system which incorporates a master board and a code book programmed by color and number to identify particular key-lock combinations.

Quite another object of this invention is to provide a uniquely designed retainer whereon identification means do not become reversed, and whereon keys will be aligned in a parallel fashion, thereby permitting ready accessibility and easy application thereof to locks.

Also, as an object of this invention particular attention is directed to the hereinafter described master key cross indexing which permits efficient key-lock identification.

Other objects of the invention will become apparent hereinafter from the specification and from the recital of the appended claims, particularly when read in conjunction with the accompanying drawings.

Figure 4:
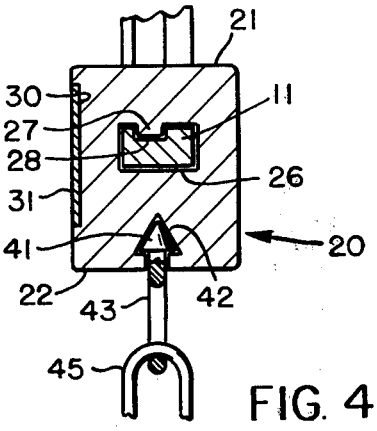
FIG. 4 is an enlarged fragmentary sectional view taken along line 4—4 in FIG. 3 looking in the direction of the arrows.

Referring now to the drawings by numerals of reference, and first to FIGS. 1 to 5, 10 denotes generally a circular retainer device comprising a spring steel ring or hoop 11 having separable ends 12 and 13 (FIGS. 1 and 5) and being rectangular in cross-section as shown in FIG. 4. Ring end 12 is releasably secured in an opening 14 in end 13 by a shackle 15, comprising a conventional wire snap having one leg 16 which projects releasably through registering openings in ends 12 and 13, as shown more clearly in FIG. 5. Shackle 15 allows the opening of the retainer 10 by withdrawing the end 12 thereof from end 13 after removal of the leg 16 of shackle 15. High tensile spring steel facilitates persistance of ring 11 into its circular form.

Figure 1:
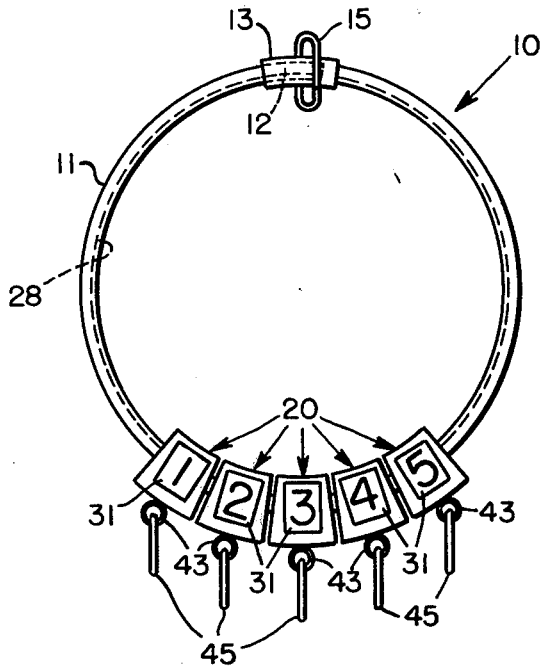
FIG. 1 is a front elevational view of a key retainer made according to one embodiment of this invention.
Figure 2:
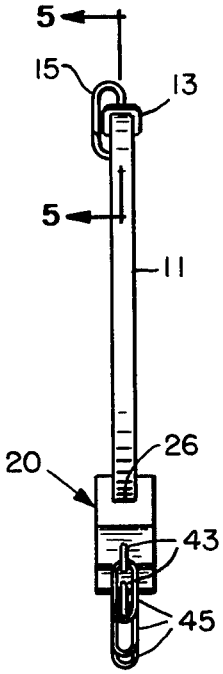
FIG. 2 is a side elevational view of this retainer.
Figure 3:
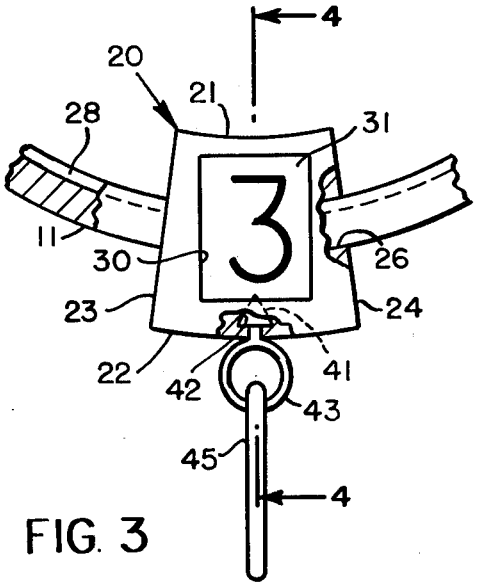
FIG. 3 is a greatly enlarged, fragmentary front elevational view of the retainer and one of the many key holder blocks mounted thereon, portions of the retainer and block being broken away and shown in section.
Figure 5:
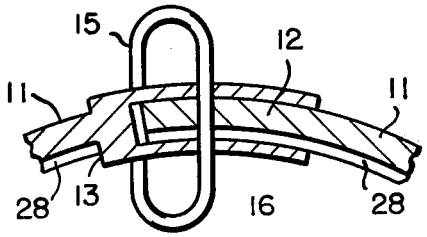
FIG. 5 is an enlarged fragmentary sectional view taken along line 5—5 in FIG. 2 looking in the direction of the arrows, and with the retainer latching pin shown in full.
Figure 6:
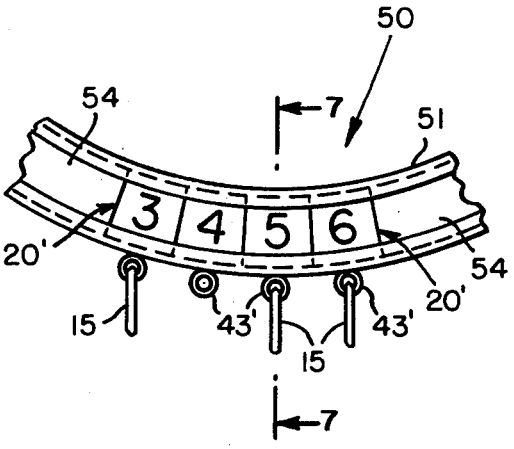
FIG. 6 is an enlarged, fragmentary front elevational view of part of a modified retainer device made in accordance with a second embodiment of this invention.
Figure 7:
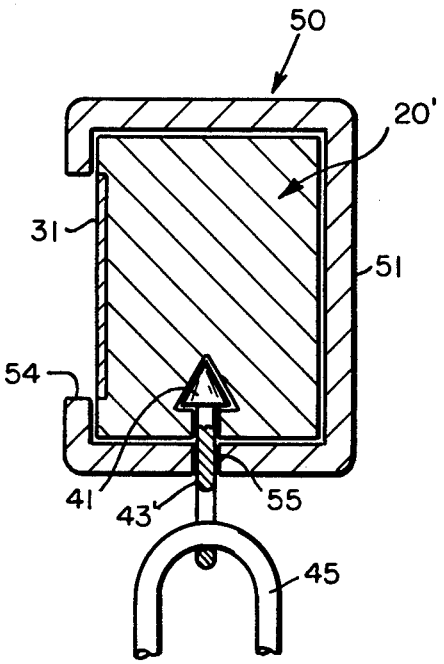
FIG. 7 is a greatly enlarged fragmentary sectional view taken along line 7—7 in FIG. 6 looking in the direction of the arrows.

Removably mounted on ring 11 is a plurality of like key holders or blocks 20, which may be manufactured of high impact acrylic or the like. Each block 20 has curvilinear inner and outer surfaces 21 and 22, respectively (FIG. 3), which are disposed generally coaxially of ring 11, and tapering sides 23 and 24, which lie in planes that extend radially of the center of ring 11, thereby to facilitate their smooth alignment on the retaining ring 11. An arcuate or curvilinear opening 26 (FIGS. 2 to 4), which is rectangular in cross section, extends through the center of each block 20 between its sides 23, 24, and along a path disposed coaxially of ring 11, when the blocks 20 are mounted thereon as shown in FIGS. 1 to 4. Each opening 26 is slightly larger in cross section than ring 11 so as to permit the blocks 20 to slide circumferentially on ring 11. Also a tongue 27 (FIG. 4) fits slidably in a groove 28 in the inner peripheral surface of ring 11 to prevent rotation of blocks 20 about the ring. Blocks 20 may be added to or removed from the retainer ring 11 by sliding them on or off the left end 12 of the ring as shown in FIGS. 1 and 5.

Sandwiched or imbedded in a recess 30 the face of each block 20 is a durable, colored tab 31, which has a number or other character imprinted thereon. Each tab 31 will remain in a stationary position and present a constant attitude and a legible identifying character, whenever the retainer 10 is held for examination by an operator.

Swivelly mounted at its conically-shaped upper end 41 in a corresponding recess 42 in the underside of each block 20 is a permanently-mounted swivel-ring 43, which is rotatable on an axis that extends through the center of ring 11. Removably mounted on each ring 43 is a snap wire 45, which may be similar to the snap wire or shackle 15 used to lock together the ring ends 12 and 13.

The modified embodiment of this invention as shown in FIGS. 6 to 9, comprises a retainer 50 intended for heavy duty commercial use. It includes a hollow, tubular ring or loop 51, which is rectangular in cross-section, and which has one end 52 thereof releasably secured by a shackle 15 (FIGS. 8 and 9) in the opposite, enlarged end 53 of the ring. A plurality of modified blocks 20' are slidably housed in the bore of ring 51 so that the tab 31 on each such block will be viewable through an arcuate opening 54 formed in the face of ring 51 intermediate its ends. A narrow slot 55 is formed in the bottom wall of ring 51 slidably to accommodate the neck portions 43' (FIG. 7) of each ring 43 on blocks 20' so that the blocks will be free to slide in the bore in ring 51.

Figure 8:
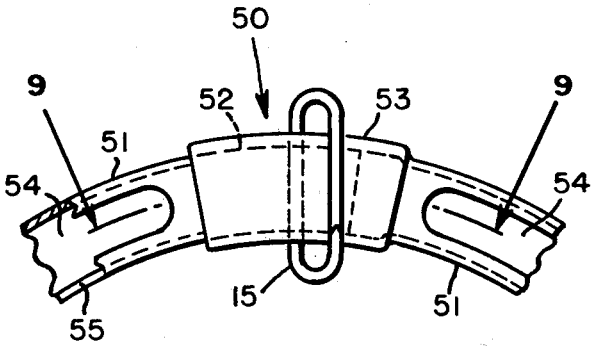
FIG. 8 is an enlarged, fragmentary front elevational view of a portion of the modified retainer device shown in FIG. 6.
Figure 9:
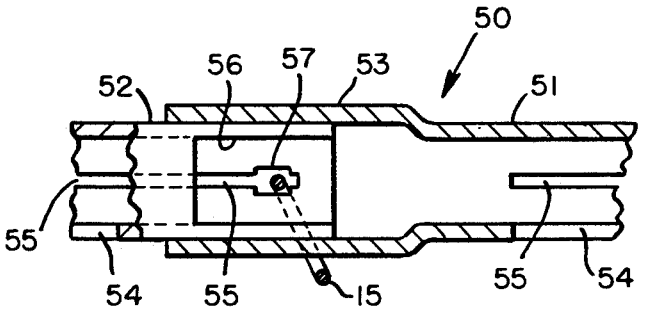
FIG. 9 is an enlarged, fragmentary sectional view taken along the line 9—9 in FIG. 8 but with a portion of the retainer shown in full.

On the left end 52 of the ring 51 a rectangular opening or notch 56 is created in the upper wall of the ring 51 to permit removal or addition of the blocks 20' when the ends 52 and 53 are separated, and when the swivel ring 43 on the block is aligned parallel with a slight enlargement 57 formed in the guide slot 55 adjacent the point where this slot terminates at the left end 52 of the ring. The locking snap wire or shackle 15 is adapted to have one leg thereof pass removably through the distal end of slot 55, when engaged as shown in FIGS. 8 and 9, and also through registering openings in the overlapping portions of the ring end 53. Also, as will be apparent from FIGS. 8 and 9, the shackle 15 prevents blocks 20' from passing out of end 52 and into end 53 of ring 51, thereby avoiding any undesirable mixing of the blocks.

The blocks 20' used in this second embodiment of the invention differ from the blocks 20 in that they are slightly larger, and they contain no opening 26.

In use, keys are affixed via snaps 45 to block swivel rings 43 in a sequence depicting the normal progression of an operator opening numerous locks. Block color indicates the specific area where a particular lock exists, and the block number (tab 31) indicates the specific lock therein. A red colored block with a tab numeral "50" could be selected arbitrarily to signify a master key. Duplicate keys may be held on a second identically indexed ring retainer; or individual keys could be removed and used or placed on a master key board while, if desired, still having a numbered block clipped to the key. The key then could still be removed from the key board or retaining ring and be readily identifiable.

Locks themselves may be identified by placing thereon duplicate, self-adhering (adhesively-backed) tabs 31, which correspond exactly to the tab 31 imbedded in the associated key block 20 or 20'. "Scotch-lite" tabs have proven to be suitable for this purpose.

A master-log book maintained near the master key board may contain colored sections, with numbered lines and with titled columns whereon specific key-lock information, such as: number, location, duplicates, possessor (name, etc.) of key, and master key application, may be recorded. Also included in the log book may be a forward section detailing the most efficient use of the method.

From the foregoing it will be apparent that the instant invention comprises a simple and accurate method and means for identifying key-lock combinations. By using the unique devices disclosed herein, even one unfamiliar with a facility's security detail can quickly determine appropriate key-lock matches, location of locks and keys, duplication facts and the identity of key holders. When using the novel retainer ring, the attached keys are indexed and readily identifiable. In addition to indexing the keys, while they are attached to the retainer ring, the novel method provides an easy way for the identification to stay with a key even after its removal from the retainer ring, and eliminates the need to print tags or labels and to tie them to respective keys.

Selection of a key for use is also made easy by this invention; and the swivel mechanism facilitates manipulation of a single key without having to turn or manipulate the entire ring and all keys thereon. The problem with large key rings without swivel attachments for the keys, is that often times the entire key ring and keys must be turned so that the particular key in use may be turned a full revolution. This is often very difficult to do, and also strains or stresses the key. Moreover in many instances it is impossible to turn the entire ring and key with one hand. Also, bulkiness is reduced by the retainer's facility to cause keys thereon to lie in a parallel fashion.

Moreover this invention's use saves time and money; keys are seldom broken or lost; locks need not be replaced for lack of a key; and the great expense of time in the search-and-try technique of key selection is alleviated. A person can simply ask for a particular key by its respective color-number code.

While in the embodiments illustrated it has been suggested that materials such as acrylic and "Scotch-lite" are satisfactory for certain purposes, it will be readily apparent to one skilled in the art that the particular materials used are matters of choice, and that equivalents thereof may be employed without departing from the inventions disclosed herein.

Having thus described my invention, what I claim is:

1. A retainer for keys, comprising a ring having two, separable ends, means for releasably securing said ends in engagement with each other to maintain said ring in a circular configuration, a plurality of like blocks slidably mounted on said ring for limited movement thereon in a circumferential path coaxially of the center of said circular ring configuration, means for releasably attaching a key to one end of each of said blocks, each of said blocks having on one side thereof an indicator surface with key identifying means thereon, and guide means for securing said blocks against rotation about the centerline of said ring with said one end of each block facing externally of said ring, and with said indicator surfaces facing in the same direction at one side of said ring, said guide means including a rectangular slot formed in one of the confronting sliding surfaces on said ring and on each of said blocks, respectively, and the other of said sliding surfaces being rectangular in cross section and being slidable in said slot.

2. A retainer as defined in claim 1, wherein said means for attaching a key to each block comprises a swivel member having a cone-shaped head rotatably mounted in a complimentary recess formed in said one end of each block, and an integral loop projecting from said head externally of the associated block.

3. A retainer as defined in claim 1, wherein one of said ends of said ring is releasably seated in a recess in the opposite end of said ring, and said means for releasably securing said ends together comprises a wire loop having one leg thereof extending releasably through registering openings in the engaged ends of said ring.

4. A retainer as defined in claim 1, wherein said ring is rectangular in cross section, and each of said blocks has therethrough a rectangular opening in which said ring is slidable when the block is mounted on the ring.

5. A retainer as defined in claim 1, wherein each of said blocks has opposed, inclined side surfaces positioned by said guide means in planes extending radially of the center of said circular ring configuration, and opposed, arcuate end surfaces, said one end of each block has thereon a convex surface, and the opposite end of each block has thereon a concave surface disposed coaxially of said convex surface and said center of said circular ring configuration.

6. A retainer as defined in claim 5, wherein said indicator surface is a plane surface extending transversely between said side surfaces of each block, and said identifying means comprises a numbered tab secured to each of said indicator surfaces.

7. A retainer as defined in claim 1, wherein said ring is hollow and has therethrough an axial bore which is rectangular in cross section, and one sidewall of said ring has therethrough an opening which extends circumferentially of the ring intermediate its ends, and said blocks are generally rectangular in cross section and are axially slidable in the bore in said ring with said identifying means on each block facing the opening in said one sidewall of the ring to be viewable from the exterior thereof.

8. A retainer as defined in claim 7, wherein the outer circumferential wall of said hollow ring has therethrough medially of its sides a narrow slot which extends around said ring intermediate its ends, and said means for attaching a key to said one end of each block comprises a swivel member having an enlarged head portion rotatable in a recess in said one end of each block, a neck portion which extends through said slot in said outer wall of said hollow ring, and an integral loop portion disposed exteriorly of said ring.

9. A retainer as defined in claim 8, wherein one end of said ring is releasably secured by said attaching means in a recess in the opposite end of said ring, said slot terminates at one end adjacent said one end of said ring, and the inner circumferential wall of said ring has in said one end of the ring a rectangular notch similar in cross section to each of said blocks to allow withdrawal of a block through said notch when the ends of the ring are separated.

* * * * *